United States Patent [19]

Strandberg et al.

[11] Patent Number: 4,481,998

[45] Date of Patent: Nov. 13, 1984

[54] DEVICE FOR OPERATING A PULL CORD

[76] Inventors: Stanley L. Strandberg, 11580 Hesby St., North Hollywood, Calif. 91601; Jerome F. Bloch, 5240 Zelzah Ave., Encino, Calif. 91316

[21] Appl. No.: 436,138

[22] Filed: Oct. 22, 1982

[51] Int. Cl.[3] ..... A47K 11/06

[52] U.S. Cl. ..... 160/344; 160/126

[58] Field of Search ..... 160/123-126, 160/330, 331, 344-347; 49/77

[56] References Cited

U.S. PATENT DOCUMENTS

| | | | |
|---|---|---|---|
| 2,468,453 | 4/1949 | Mallentjer | 160/331 |
| 2,607,452 | 8/1952 | Hall | 49/77 |
| 2,758,345 | 8/1956 | White | 49/77 |
| 3,096,078 | 7/1963 | Steingass et al. | 160/331 |
| 3,269,454 | 8/1966 | Gill et al. | 160/331 |
| 3,438,423 | 4/1969 | Melull et al. | 160/331 |
| 3,590,900 | 7/1971 | Salzmann | 160/344 |
| 4,031,944 | 6/1977 | Morrison et al. | 160/331 |

*Primary Examiner*—Peter M. Caun

*Attorney, Agent, or Firm*—Nilsson, Robbins, Dalgarn, Berliner, Carson & Wurst

[57] ABSTRACT

A device is provided for applying tensile forces to a flexible cord to draw the cord toward the device. The device has a base, a drive wheel rotatably mounted to the base and a pair of traction rollers within the plane of the drive wheel. The cord circumferentially engages the drive wheel and is urged against it in secure frictional engagement by the rollers. In a preferred embodiment, the rollers are carried at opposite ends of a connector link which is mounted for pivotal movement relative to the base. The cord extends around the drive wheel as a loop and two leads of the loop are guided outwardly from the wheel by the rollers. The rollers and the connecting link are arranged such that tensioning one lead of the rope by rotation of the drive wheel causes the corresponding roller to move away from the drive wheel, forcing the other roller and the other lead against the drive wheel.

17 Claims, 7 Drawing Figures

DEVICE FOR OPERATING A PULL CORD

BACKGROUND OF THE INVENTION

The invention relates generally to a device for applying tensile forces to a flexible cord and, more particularly, to a device for operating a set of traverse drapes or other window covering structure having a pull cord.

A number of hand crank mechanisms have been proposed to open and close curtains, shutters and similar structures. Examples of such mechanisms are disclosed in the following patents: U.S. Pat. No. 929,742 to Wilson; U.S. Pat. No. 1,255,817 to Gibson et al.; U.S. Pat. No. 1,726,854 to Mumford; U.S. Pat. No. 1,734,800 to Faulds; U.S. Pat. No. 1,849,371 to Gronbech.

The Faulds and Gronbech patents relate to drive wheel arrangements for frictionally engaging an actuating cord to operate a reciprocating window-related structure. However, it is difficult in devices of this type to attain sufficient friction between the cord and the drive wheel to prevent slippage. The problem of slippage is particularly acute in the operation of inexpensive traverse drapes and other window covering structures because they often present substantial drag forces which must be overcome by the device. For example, some traverse drape assemblies have been found to require forces up to approximately 40 pounds to operate.

A somewhat different apparatus is described in U.S. Pat. No. 2,341,123 to Schweller, wherein a flexible sheet metal closure is moved up and down the front of a refrigerator by a drive pulley acting through a cord. A pair of spring loaded idler rollers are provided to tension the cord, presumably increasing friction. However, the tensioning effect is a function of the spring force and is independent of the force applied to the drive pulley.

Therefore, it is desirable in many applications to provide a simple and smooth-acting device capable of applying substantial tensile forces to a flexible cord to draw the cord toward the device.

SUMMARY OF THE INVENTION

The present invention comprises a device for applying a tensile force to a flexible cord, comprising: a base; a drive wheel rotatably mounted to the base and engageable with the cord between first and second portions of the cord such that the cord extends substantially around the drive wheel; first and second roller means located within the plane of the drive wheel and engageable with the first and second portions of the cord, respectively, to guide them outwardly from the drive wheel; means for coupling the first and second roller means for movement within the plane of the drive wheel between first and second alternate conditions such that, in each of the conditions, tension of one of the portions of the cord acts to move the respective roller means away from the drive wheel and thereby urge the other roller means and the other portion of the cord against the drive wheel in frictional engagement therewith; and means for selectively rotating the drive wheel in either of two opposite directions to tension one of the portions of the cord; whereby the one portion of the cord can be drawn toward the device by rotation of the drive wheel. In a preferred embodiment, the coupling means is a connector link which carries the rollers at a pair of spaced locations thereon and is mounted to the base for movement between positions corresponding to the first and second conditions of the rollers. The connector link may be mounted to the base for pivotal movement between the positions about a first axis spaced from the drive wheel. In another preferred embodiment, the device may include a pair of the coaxial drive wheels, each of which has first and second rollers associated with it. The means for rotating the drive wheels can then be selectively engaged with them to tension either of two distinct cords.

The device of the present invention operates smoothly and surely to apply high levels of tension to a flexible cord in either of two opposite directions. Part of the force is transferred through the roller assembly to urge another portion of the cord against the drive wheel in secure frictional engagement therewith. As the tensile force is increased, the force with which the cord is urged against the drive wheel is also increased. The friction between the cord and the drive wheel is thus automatically controlled in accordance with the driving force. The device of the present invention has been operated with a conventional drape cord to produce a pulling power of up to 140 lbs.

Because the rollers of the present invention apply an inward force to the drive wheel in proportion to the driving force, the device operates in most circumstances with very little drag. The inward force, and any drag associated with it, is no greater than required to prevent slippage.

The dual drive wheel structure of the present invention permits two distinct apparatuses to be operated by a single device. For example, two sets of drapes mounted to a double traverse assembly can be operated independently by the device. A single winder handle selectively actuates the drive wheels, depending upon the position of an axial selector shaft.

BRIEF DESCRIPTION OF THE DRAWINGS

The above and other features of the present invention may be more fully understood from the following detailed description, taken together with the accompanying drawings, wherein similar reference characters refer to similar elements throughout and in which.

DESCRIPTION OF THE PREFERRED EMBODIMENT

Figure 1:
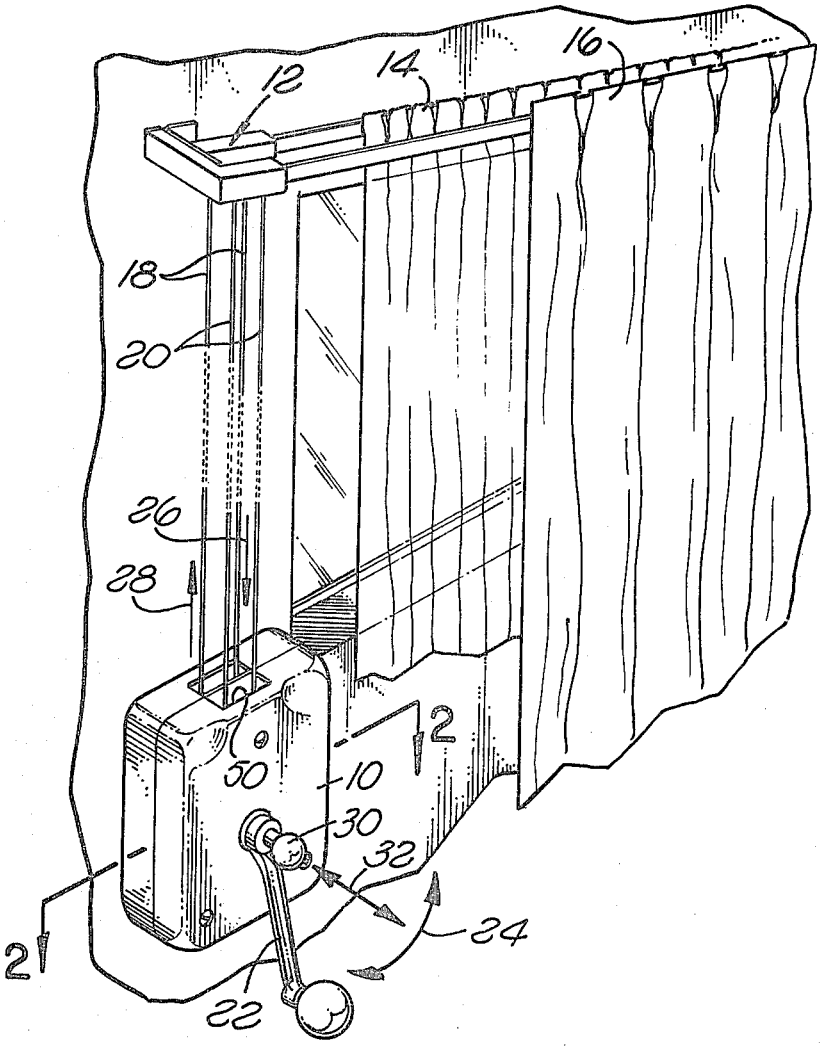
FIG. 1 is a perspective view of the cord operating device of the present invention in position to operate two sets of window drapes.

Referring now to the drawings, FIG. 1 illustrates a cord operating device 10 constructed in accordance with the present invention, and a traverse rod assembly 12 with two sets of drapes 14 and 16. The operating device 10 acts on cords 18 and 20 of the rod assembly 12 to open and close the drapes. This is accomplished by rotating a winder handle 22 in either of two opposite directions, indicated at 24. The direction of drape movement is determined by the direction of handle rotation. For instance, clockwise rotation of the handle 22 might cause the right hand lead of the cord 18 to be drawn downwardly in the direction indicated at 26 while the left hand lead moves upwardly in the direction 28. The device 10 can be caused to operate either the set of drapes 14 or the set of drapes 16, depending upon the axial position of a selector knob 30. Thus, the selector knob is moveable back and forth in the direction indicated at 32 to selectively engage the winder handle with the cords 18 and 20.

Figure 4B:
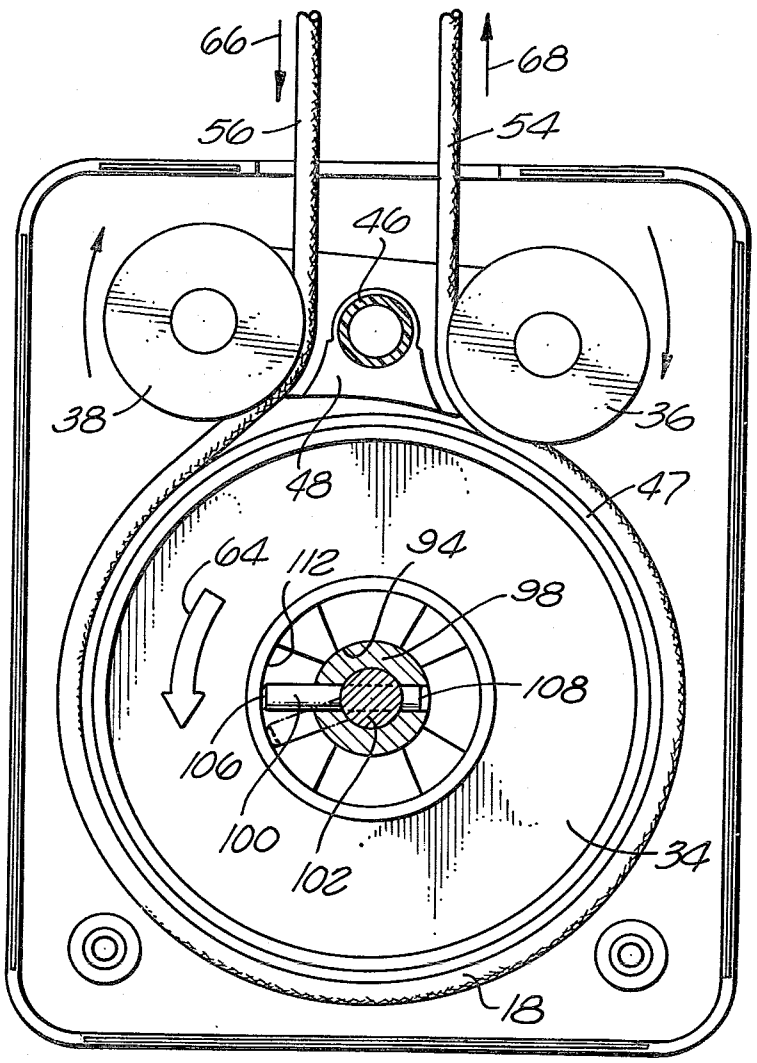
FIGS. 4A and 4B are somewhat schematic vertical sectional views taken along the line 4—4 of FIG. 2, illustrating the first and second conditions of operation of the device.
Figure 4A:
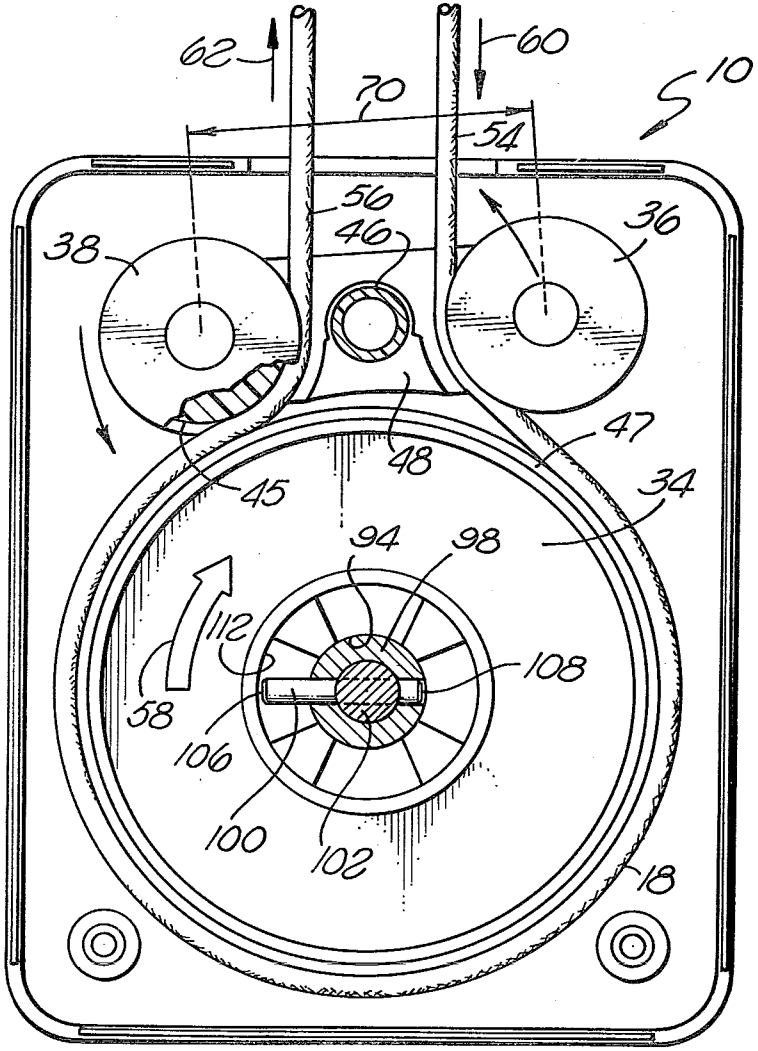

Referring briefly to FIGS. 4A and 4B, a major advantage of the present invention is the secure frictional engagement obtained between the flexible cord and a drive wheel 34 driven by the winder handle 22. The frictional engagement is achieved by virtue of first and second friction rollers 36 and 38 which are connected by a link 40 for movement between the first and second conditions illustrated in FIGS. 4A and 4B, respectively. In each condition, tension of one of the leads of the cord 18 acts to move one of the rollers generally away from the wheel 34 and pivot the other roller against the wheel. This forces the second lead against the wheel, increasing friction between the cord and the wheel so that the cord can be pulled without slipping.

Figure 3:
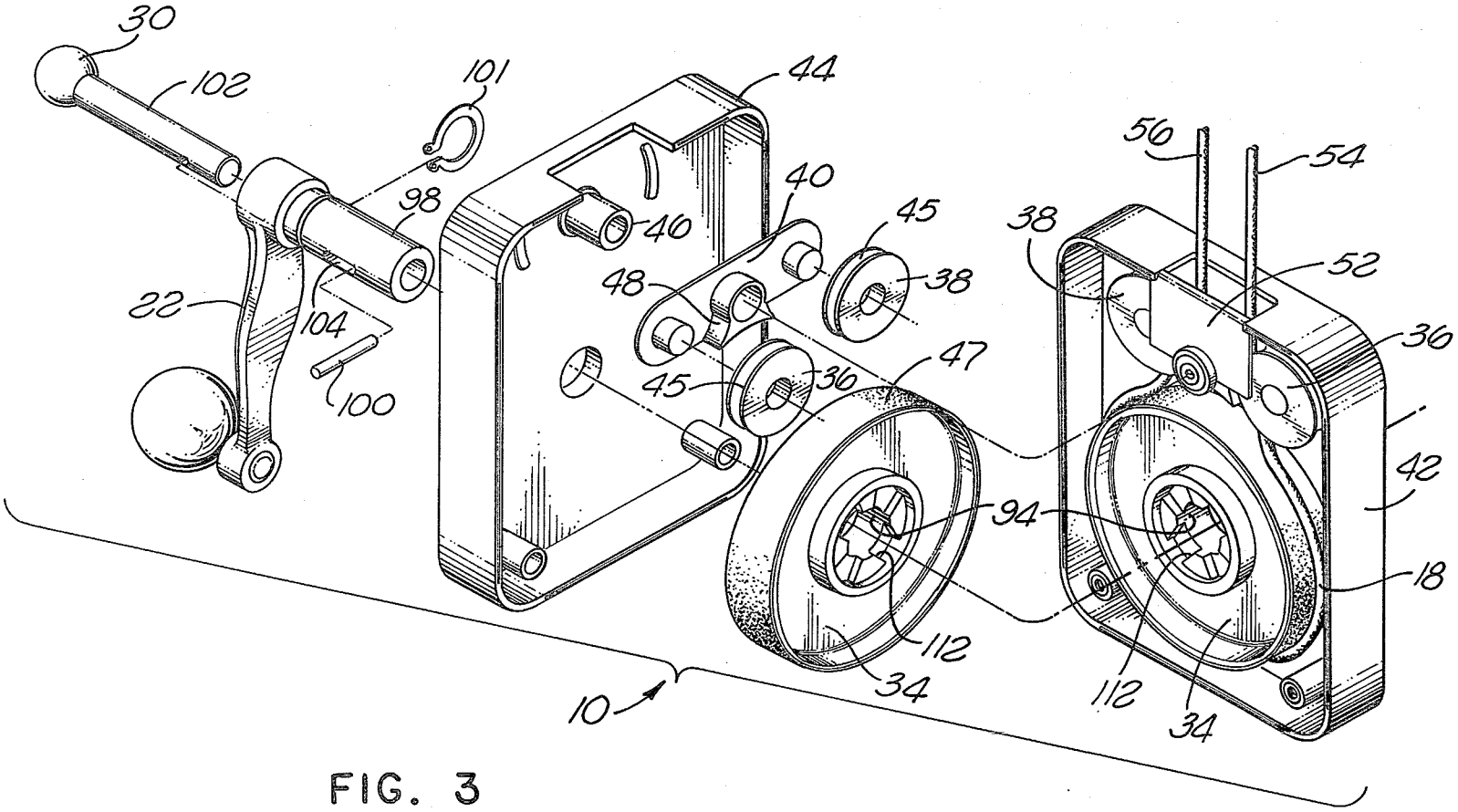
FIG. 3 is an exploded perspective view of the cord operating device of FIG. 1.

Referring now to FIG. 3, the cord operating device 10 includes a pair of similar drive wheels 34 arranged back to back within a housing formed by a back portion 42 and a front portion 44. The drive wheels are provided with a corresponding pair of rollers 36 and 38 which are mounted for free rotation at opposite ends of the connecting links 40. Each of the rollers has an annular groove 45 for reception of the cord 18 or 20, and the drive wheels are coated with rubber or other suitable high friction material 47 at their radially outer surfaces. The connecting links are journaled on corresponding posts 46 of the two housing portions for pivotal movement about an axis parallel to the axis of the wheels. Each pair of rollers is maintained within the plane of its drive wheel and allowed to pivot with the connecting link between the first and second conditions of FIG. 4. A boss portion 48 is provided at the midpoint of the connecting link to aid in guiding the cords in these conditions. The cords enter and leave the device 10 through an upper opening 50 of the housing. A low-friction separating plate 52 is preferably provided between the two pairs of rollers to permit smooth and independent pivotal movement of the connector links.

As seen in FIG. 4A, the cord 18 is formed in a loop which extends substantially around the circumference of the drive wheel and has first and second portions 54 and 56 respectively, which are guided outwardly from the drive wheel by the rollers 36 and 38. The portions of the cord pass between the respective rollers and the boss portion 48, emerging generally parallel to each other. In the condition illustrated in FIG. 4A, the drive wheel 34 is rotated in a clockwise direction 58 to tension the first portion 54 of the cord and thus apply an outward and upward force on the first friction roller 36. The upward component of this force acts to pivot the connecting link 40 about the post 46 and thus move the roller 36 away from the wheel 34. At the same time, the second friction roller 38 moves inwardly against the periphery of the wheel to firmly engage the second cord portion with the wheel, and cause the lower part of the cord to move clockwise with the wheel. The first cord portion 54 is thus drawn toward the device 10 in a direction 60, while the second cord portion 56 is allowed to pass from the device in a direction 62. If the device 10 is faced with a substantial force restraining the first cord portion 54, the upward force on the roller 36 and the downward force on the roller 38 are similarly increased. This enhances the friction between the cord and the drive wheel 34, permitting the device to operate without cord slippage.

FIG. 4B illustrates the second condition of the friction rollers, wherein the drive wheel 34 is rotated in a counterclockwise direction 64 to tension the second cord portion 56 and swing the second friction roller 38 upwardly in the indicated direction. This forces the first friction roller downwardly against the drive wheel, as indicated, providing the desired frictional engagement with the drive wheel. As a result, the second cord portion is drawn toward the device 10 in a direction 66 as the first cord portion is allowed to pass from the device in a direction 68.

It will be understood that, in the preferred embodiment of the present invention, the spacing 70 of the friction rollers is substantially less than the diameter of the drive wheel 34. This permits the friction roller and connecting link structure to pivot in the desired manner between the conditions of FIGS. 4A and 4B.

The device 10 is actuated between the first and second conditions illustrated in FIGS. 4A and 4B, respectively, simply by changing the direction of rotation of the drive wheel 34. In the case of a cord 18 formed in the shape of a reciprocable loop, such as that of the traverse rod assembly 12, the device 10 functions alternately between the first and second conditions to open and close the drapes 14 (FIG. 1). As long as any slack of the cord 18 is minimal, the transition between the two conditions will be smooth and rapid. Otherwise, it may be necessary to rotate the drive wheel through a small angle to take up the slack in the cord before the friction wheels assume a particular condition of engagement with the drive wheel. It is therefore not necessary that all of the slack be removed from the cord 18, and it is preferable that there be no pre-existing tension on the cord which might interfere with pivotal movement of the connecting link.

Figure 5:
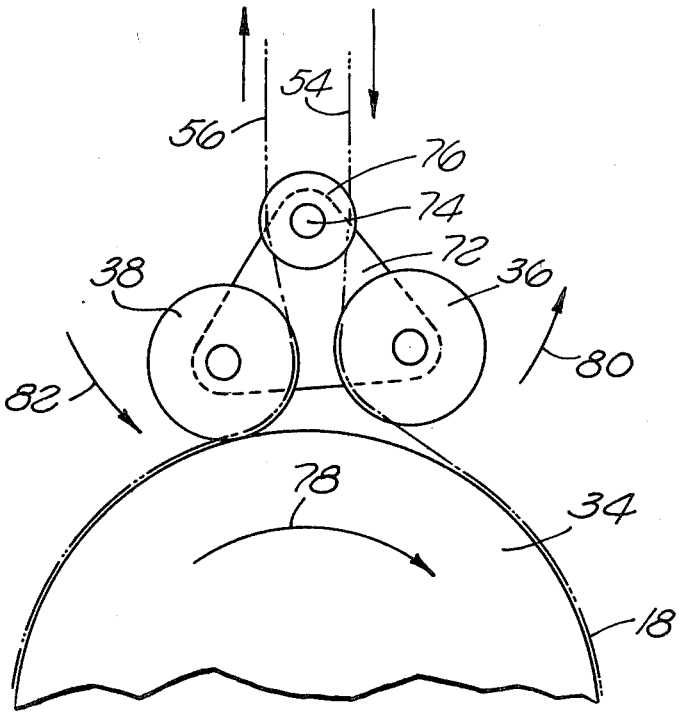
FIG. 5 is a schematic representation of another preferred embodiment of the device, showing a first condition of operation of the traction roller assembly.
Figure 6:
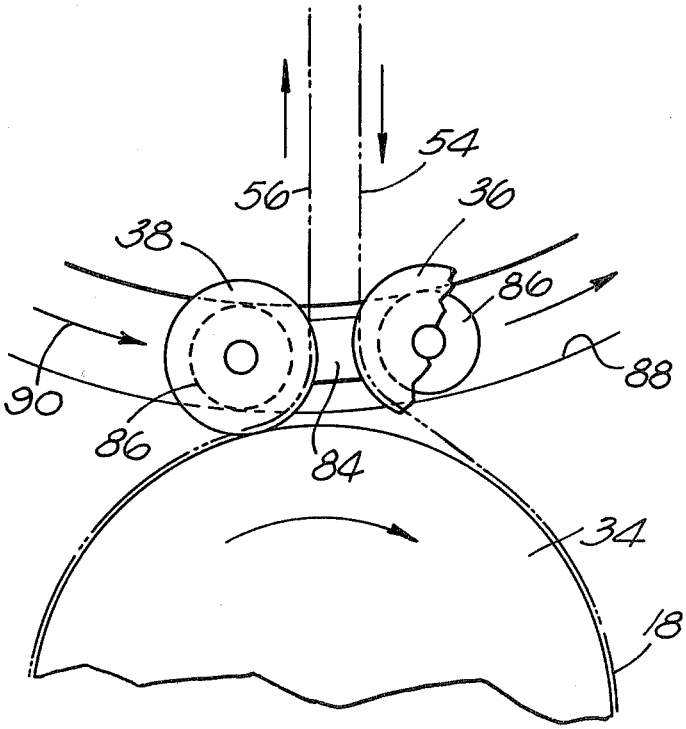
FIG. 6 is a schematic representation of a further preferred embodiment of the device, showing a first condition of operation of the traction roller assembly.

FIGS. 5 and 6 schematically illustrate two other preferred embodiments of the friction roller structure of the present invention. With reference first to FIG. 5, the rollers 36 and 38 are supported by a triangular connector link 72 which is mounted to the housing at a pivot point 74 above the rollers. An auxiliary guide roller 76 can be provided at the pivot point 74 to guide and space the portions 54 and 56 of the cord 18. By moving the pivot point of the connector link above the two rollers, the direction of roller movement is made to coincide more closely with the direction of the force applied to the rollers by cord tension. The drawing of FIG. 5 corresponds to the first condition of FIG. 4A, wherein the drive wheel is rotated in a direction 78 to tension the first cord portion 54 and swing the roller 36 away from the wheel in a direction 80. The second roller 38 is consequently urged against the drive wheel in a direction 82 to provide secure frictional engagement of the cord 18 with the drive wheel. The action of the friction rollers and the connector link is further enhanced by the fact that the direction 82 is more closely tangential to the drive wheel than the corresponding direction of the roller 38 in FIG. 4A. Two additional advantages of the arrangement of FIG. 5 relate to the close spacing of the friction rollers and the additional guidance of the cord by the auxiliary roller 76. This arrangement is thus particularly suitable for use where lateral space is at a premium or where it is important that the leads of the cord be accurately spaced.

In the embodiment of FIG. 6, the friction rollers 36 and 38 are mounted to a connector link 84 having a pair of guide wheels 86 which ride along a track 88. Tension of the first cord portion 54 thus acts on the roller 36 in the manner described above to move the connector link 84 to the right and urge the roller 38 against the drive wheel in a direction 90. The track 88 may be an arcuate track of very large effective radius, or may be a straight horizontal track, depending upon the frictional requirements of the application. Like the embodiment of FIG. 5, this arrangement permits extremely secure frictional engagement between the second roller 38 and the drive wheel 34 because the direction 90 is more closely tangential to the wheel than the corresponding direction of FIG. 4A.

It will be understood that the embodiments of FIGS. 5 and 6 are actuable between the illustrated conditions and corresponding opposite conditions (not shown) which are similar to the second condition of FIG. 4B. Each of the two embodiments functions in a manner similar to that described above in relation to the device 10.

Figure 2:
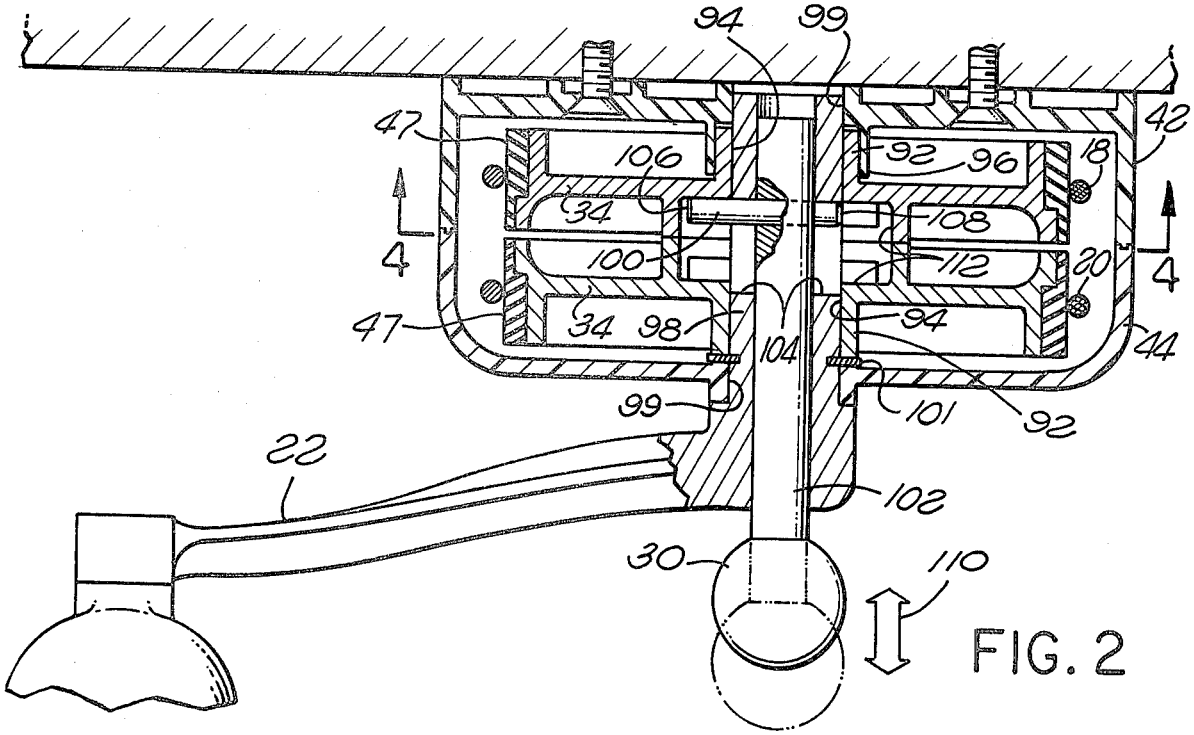
FIG. 2 is a horizontal sectional view of the cord operating device taken along the line 2—2 of FIG. 1.

Another significant feature of the present invention, the structure for selecting between the two winding mechanisms within the housing portions 42 and 44, can be seen in detail in FIG. 2. The rotatable drive wheels 34 are positioned back to back within the housing formed by the portions 42 and 44. Each of the drive wheels has an outer annular flange 92 and a central bore 94. The flange 92 of the rear drive wheel is engageable with an inwardly directed annular flange 96 of the rear housing portion to journal the rear drive wheel within the housing. A hollow drive shaft 98 is rotatably received within the bores 94 of the wheels and a pair of openings 99 of the housing to align and permit relative rotation of the components. The shaft 98 is retained within the front portion 44 of the housing by a snap ring 101. Driving engagement between the drive shaft 98 and the wheels 34 is achieved by a selector pin 100 carried by a shaft 102 which passes axially through the drive shaft. The selector pin passes through a pair of slots 104 of the drive shaft between a first end 106 and a second end 108 of the pin. The first end extends radially beyond the shaft while the second end may be essentially flush with the shaft. The slots 104 are elongated axially of the drive shaft to permit movement of the pin 100 in the direction 110 between alternate conditions of engagement with radial recesses 112 of the two drive wheels. Thus, axial movement of the shaft 102 by the knob 30 permits the drive shaft 98 to be selectively engaged with either of the drive wheels 34 to drive the corresponding cord.

In operation, the device 10 is initially set up with the cords 18 and 20 loomed through the respective halves of the device in the manner of FIG. 4. At this time, most of the slack in the two cords can be removed by appropriate adjustment of the cords or positioning of the device 10. From then on, the device 10 requires no further adjustment and is suitable for operating the two sets of drapes or other apparatuses to which it is connected by winding the handle 22 in the appropriate direction. When it is desired to switch from movement of one of the drapes to the other, the selector knob 30 is moved inwardly or outwardly for engagement with the opposite drive wheel 34.

The various elements of the device 10 can be manufactured from any of a variety of suitable materials, including aluminum or plastic, without unduly limiting the force which can be applied by the device.

From the above, it can be seen that there is provided a simple and effective device for applying relatively high tensile forces to flexible cords, such as those used to draw drapes or other window coverings.

The appended claims are not limited to the embodiments described, but rather are intended to cover all variations and adaptations within the true scope and spirit of the present invention.

What is claimed is:

1. A device for applying a tensile force to a flexible cord, comprising:

a base;

a drive wheel rotatably mounted to the base and engageable with the cord between first and second portions of the cord such that the cord extends substantially around the drive wheel;

first and second roller means within the plane of the drive wheel and engageable with the first and second portions of the cord, respectively, to guide them outwardly from the guide wheel;

means for coupling the first and second roller means for movement within the plane of the drive wheel between first and second alternate conditions such that, in each of the conditions, tension of one of said portions of the cord acts to move the respective roller means away from the drive wheel so as to urge the other roller means and the other portion of the cord against the drive wheel in frictional engagement therewith; and means for selectively rotating the drive wheel in either of two opposite directions to tension one of said portions of the cord.

whereby said one portion of the cord can be drawn toward the device by rotation of the drive wheel.

2. The device of claim 1 wherein:

the coupling means is a connector link rotatably supporting the roller means at a pair of spaced locations thereon; and the connector link is mounted to the base for movement between positions corresponding to said first and second conditions of the roller means.

3. The device of claim 2 wherein:

said locations are spaced apart by a distance less than the diameter of the drive wheel.

4. The device of claim 2 wherein:

the connector link is mounted to the base for pivotal movement between said positions about a first axis spaced from the drive wheel.

5. The device of claim 4 wherein:

the first axis is located midway between said spaced locations.

6. The device of claim 4 wherein:

the first axis is located outwardly of said spaced locations.

7. The device of claim 6 which further comprises:

a third roller means within the plane of the drive wheel and rotatable about said first axis to engage the first and second portions of the cord in a spacing relationship.

8. The device of claim 2 wherein:

the connector link is mounted to the base for substantially translational movement between said positions.

9. The device of claim 8 wherein:

the base includes track means for guiding the connector link between said positions.

10. The device of claim 2 which comprises:

a pair of coaxial drive wheels, each having first and second roller means;

whereby either of two distinct cords can be tensioned.

11. The device of claim 10 wherein:

the means for rotating the drive wheels comprises means for selectively engaging the drive wheels in a rotary driving relationship.

12. The device of claim 11 wherein:

the selective engagement means comprises spline means carried by a rotatable drive shaft and alternately engageable with recesses of the two drive wheels.

13. The device of claim 12 wherein:

the spline means is actuable axially between conditions of engagement with the recesses of the two wheels.

14. The device of claim 13 wherein:

the drive shaft is hollow and defines at least one slot elongated in the axial direction;

the spline means includes an auxiliary shaft passing axially through the drive shaft and a pin carried by the auxiliary shaft; and the pin extends radially through the slot for engagement with the drive wheels and is actuable axially along the slot between said conditions of engagement.

15. The device of claim 2 wherein:

the means for rotating the drive wheel comprises a hand crank mechanism.

16. A device for actuating a reciprocable cord in the form of a closed loop, comprising:

a base;

a drive wheel rotatably mounted to the base and engageable with the closed loop between first and second portions of the loop, such that the loop extends substantially around the drive wheel;

first and second roller means located within the plane of the drive wheel and engageable with the first and second portions of the loop, respectively, to guide them outwardly from the guide wheel;

means for coupling the first and second roller means for movement within the plane of the drive wheel between first and second alternate conditions such that, in each of the conditions, tension of one of said portions of the loop acts to move the respective roller means away from the drive wheel so as to urge the other roller means and the other portion of the loop against the drive wheel in frictional engagement therewith; and means for selectively rotating the drive wheel in either of two opposite directions to tension one of said portions of the loop;

whereby said one portion of the loop can be drawn toward the device by rotation of the drive wheel.

17. A device for applying a tensile force to a flexible cord, comprising:

a base;

a drive wheel rotatably mounted to the base and engageable with the cord between first and second portions of the cord such that the cord extends substantially around the drive wheel;

first and second rollers within the plane of the drive wheel and engageable with the first and second portions of the cord, respectively, to guide them outwardly from the guide wheel;

link means supporting the first and second rollers at spaced locations thereon and pivotable about an axis spaced from the drive wheel between a first condition in which tension of the first portion of the cord acts on the first roller to pivot the second roller and the second portion of the cord against the drive wheel, and a second condition in which tension of the second portion of the cord acts on the second roller to pivot the first roller and the first portion of the cord against the drive wheel; and means for selectively rotating the drive wheel in either of two opposite directions to tension one of said portions of the cord;

whereby said one portion of the cord can be drawn toward the device by rotation of the drive wheel.

* * * * *